US005570805A

United States Patent [19]

Harding

[11] Patent Number: 5,570,805

[45] **Date of Patent: * Nov. 5, 1996**

[54] STORAGE CONTAINER ASSEMBLY FOR COMBUSTIBLE LIQUIDS

[75] Inventor: Charles W. Harding, Clarkston, Mich.

[73] Assignee: Clawson Tank Company, Clarkston, Mich.

[ * ] Notice: The portion of the term of this patent subsequent to Feb. 28, 2014, has been disclaimed.

[21] Appl. No.: 407,600

[22] Filed: Mar. 20, 1995

Related U.S. Application Data

[63] Continuation of Ser. No. 203,666, Feb. 28, 1994, Pat. No. 5,398,841, which is a continuation of Ser. No. 46,035, Apr. 12, 1993, abandoned, which is a continuation-in-part of Ser. No. 766,452, Sep. 26, 1991, Pat. No. 5,201,435.

[51] Int. Cl.[6] ..... B65D 90/16

[52] U.S. Cl. ..... 220/565; 220/694; 220/500; 220/415; 220/86.1

[58] Field of Search ..... 220/571, 565, 220/694, 86.1, 445, 500, 729

[56] References Cited

U.S. PATENT DOCUMENTS

| | | | |
|---|---|---|---|
| 1,520,230 | 12/1924 | Flath . | |
| 1,970,940 | 8/1934 | Laube | 72/14 |
| 2,256,673 | 9/1941 | Hansen | 220/15 |
| 2,260,356 | 10/1941 | White | 62/1 |
| 2,673,010 | 3/1954 | Barrow | 222/182 |
| 2,777,295 | 1/1957 | Bliss et al. | 62/1 |
| 2,876,925 | 3/1959 | Wall et al. | 220/18 |
| 3,125,388 | 3/1964 | Costantini et al. | 312/214 |
| 3,338,010 | 8/1967 | Waugh | 52/249 |
| 3,352,443 | 11/1967 | Sattelberg et al. | 220/9 |
| 3,411,654 | 11/1968 | Grabner et al. | 220/1 |
| 3,473,689 | 10/1969 | Hutter | 220/18 |
| 3,930,590 | 1/1976 | Ebbrell | 220/9 |
| 4,425,743 | 1/1984 | Bartur | 52/169.5 |
| 4,519,415 | 5/1985 | Carn | 137/318 |
| 4,714,170 | 12/1987 | Scott | 220/5 |
| 4,960,222 | 10/1990 | Fields, III | 220/5 |
| 4,976,912 | 12/1990 | Madle et al. | 376/249 |
| 5,033,637 | 7/1991 | Webb | 220/565 |
| 5,033,638 | 7/1991 | Cruver et al. | 220/571 |
| 5,154,312 | 10/1992 | Robbins | 220/724 |
| 5,201,435 | 4/1993 | Harding et al. | 220/415 |

FOREIGN PATENT DOCUMENTS

| | | |
|---|---|---|
| 41637 | 5/1937 | Netherlands . |

*Primary Examiner*—Joseph M. Moy
*Attorney, Agent, or Firm*—Barnes, Kisselle, Raisch, Choate, Whittemore & Hulbert, P.C.

[57] ABSTRACT

An above ground storage container assembly comprises a steel tank for volatile liquid housed within a concrete vault. The walls of the vault are spaced from the tank to provide an air envelop around the tank. The air envelop is vented to prevent the tank from rusting or corroding. Lifting bars are anchored in the vault so that the entire assembly may be raised. A spill trap surrounds the fill opening from the tank and also surrounds a drain hole with removable plug.

7 Claims, 2 Drawing Sheets

STORAGE CONTAINER ASSEMBLY FOR COMBUSTIBLE LIQUIDS

REFERENCE TO RELATED APPLICATION

This application is a continuation-in-part of application, Ser. No. 08/203,666, filed Feb. 28, 1994, now U.S. Pat. No. 5,398,841 which was a continuation of Ser. No. 08/046,035, filed Apr. 12, 1993, now abandoned, which in turn was a continuation-in-part of Ser. No. 07/766,452, filed Sep. 26, 1991, now U.S. Pat. No. 5,201,435.

FIELD OF INVENTION

This invention relates generally to an above ground storage container assembly and refers more particularly to such an assembly having a steel tank for volatile and combustible liquids within a concrete vault.

BACKGROUND AND SUMMARY OF THE INVENTION

The storage of combustible and flammable liquids such as gasoline, diesel fuel and other similar liquids has long been a problem. With above ground tanks, it has been common to provide a collecting space in the form of a dike which would contain the liquid of the tank in the event of a spill.

It is an object of the present invention to provide an above ground storage facility including an inner steel tank for the desired quantity of liquid. A fireproof concrete vault encases the inner tank. An annular space between the outside of the inner tank and the inside of the protective concrete vault serves as a containment volume for any liquid or vapors escaping from the steel tank and also as a fire barrier in the event of combustion.

The invention also contemplates ventilation for the space between the tank and the vault to dissipate condensation. Thus, the tank wall will remain dry and be prevented from rusting and from corrosion.

The outer vault can be constructed of a suitable concrete which has a high resistance to flame and heat as well as being bulletproof and impact resistant.

The outer vault may be constructed with a peninsula serving as an extension to support a liquid-dispensing pump. The piping supplying fuel to the pump is encased in the vault wall and peninsula so that piping to the pump need not run underground where a leak could cause pollution to subterranean ground water.

Other objects, features and advantages of the invention will become apparent as the following description proceeds, especially when considered with the accompanying drawings.

DETAILED DESCRIPTION OF THE PREFERRED EMBODIMENT

Figure 1:
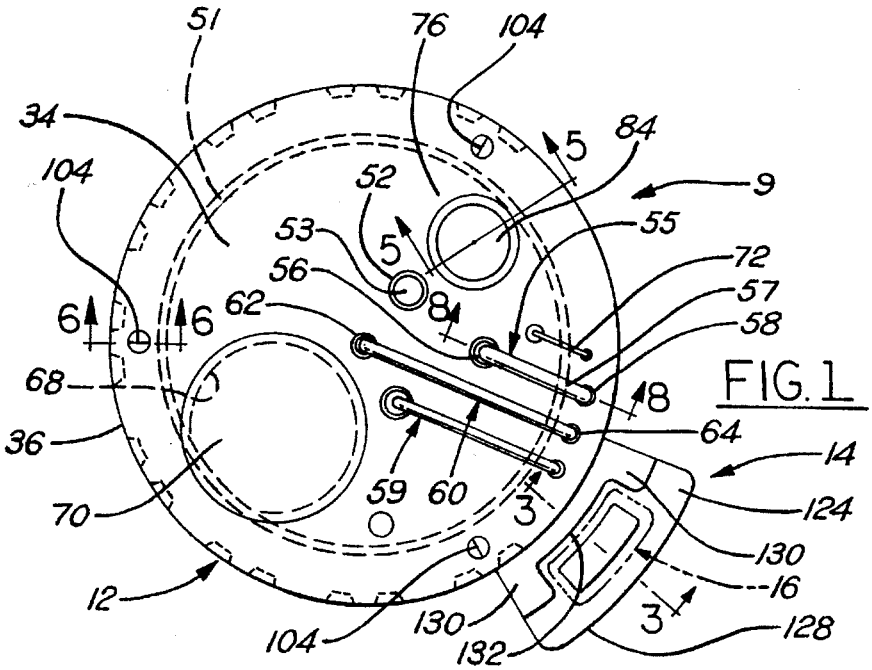
FIG. 1 is a top view of an above ground storage container assembly constructed in accordance with the invention, but with the liquid dispensing pump shown in phantom lines.

Referring now more particularly to the drawings, the above ground storage tank assembly 9 of this invention comprises an inner tank 10 and an outer vault 12, the outer vault 12 having a peninsula 14 for supporting a liquid-dispensing pump 16.

The inner tank 10 is made of steel or plastic and comprises a bottom wall 18, a top wall 20 and a vertical, annular, cylindrical side wall 22.

The bottom wall 18 of the inner tank 10 may be a separate panel having an annular upturned flange 24 marginally secured at 26 as by welding to the lower edge portion of the annular side wall 22.

The top wall 20 of the inner tank 10 may be a separate panel having an annular downturned flange 28 marginally secured at 30 as by welding to the upper edge portion of the annular side wall 22.

The bottom, top and side walls 18, 20 and 22, respectively, define a closed interior space or chamber for containing a volatile flammable liquid.

The vault 12 is preferably made of concrete and has a base or bottom wall 32, a top wall 34 and a vertical, annular, cylindrical side wall 36.

The bottom wall 32 and side wall 36 of the vault 12 may be cast together as one integral concrete unit. The top wall 34 is preferably in the form of a separate cap of the same concrete material as the bottom and side walls and its radially outer peripheral edge portion is preferably secured as by grouting 38 to the upper marginal edge of the side wall 36.

The bottom, top and side walls 32, 34 and 36, respectively, form a container defining a closed interior space or chamber in which the inner tank 10 is disposed.

On the upper surface 42 of the base or bottom wall 32 of the vault 12 are a plurality of laterally spaced apart parallel, elongated, upstanding ribs 44, the opposite ends of which terminate short of the side wall 36. The tops of the ribs 44 occupy a common horizontal plane. The inner tank 10 is enclosed within the vault 12 with its bottom wall 18 resting on and supported by the ribs 44.

Figure 2:
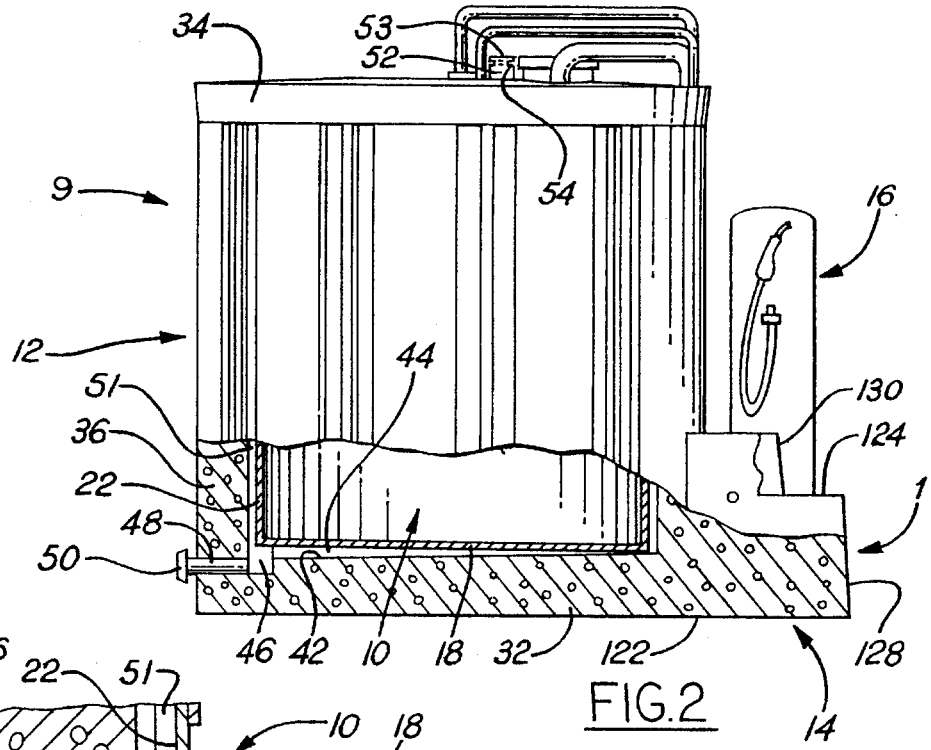
FIG. 2 is a side elevational view of the above ground storage container assembly shown in FIG. 1, with parts in section and showing the liquid-dispensing pump.
Figure 4:
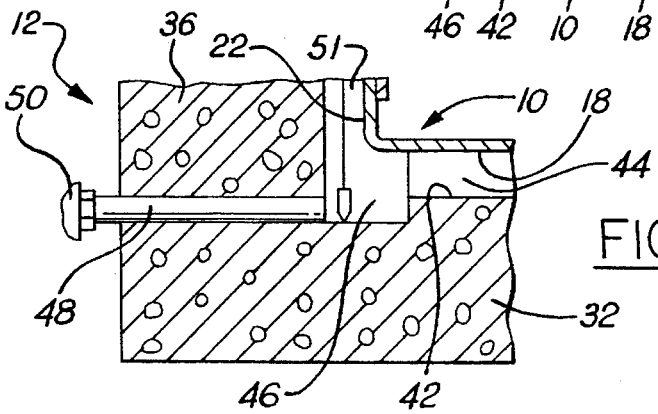
FIG. 4 is an enlarged sectional view of a portion of FIG. 2.

The upper surface 42 of the base or bottom wall 32 of the vault between the ribs slants downward toward the left in FIG. 2. This will provide a drainage to an annular sump basin 46 which extends completely around the bottom of the vault and can be tapped through the outlet passage 48 that is normally closed by a removable plug 50. The raised ribs 44 and angled upper surface 42 prevent moisture accumulation against the tank bottom, thus preventing exterior rust or corrosion. The placement of the tank 10 within the vault, and their relative dimensions are such that the side wall of the vault is spaced laterally outwardly from the side wall of the tank around the full circumference of the tank, and the top wall or cap of the vault is spaced vertically above the top wall of the tank, so that there is an air envelop 51 completely around the sides, top and bottom (except for the ribs 44) of the tank. The top wall or cap 34 has a vent pipe 52 communicating with the interior of the vault 12 to ventilate the air envelop and prevent the accumulation of moisture, vapor and the like. The pipe 52 has a lid 53 to protect against the entry of the elements, and has side vents 54. Air may enter or exit the air envelop 51.

The concrete vault 12 is preferably made with Siliceous Aggregate Concrete with a wall thickness of about 6". This will provide a 200° F. fire endurance, internally or externally, of about 3 hours based on 260° F. (139° C.) rise in temperature of unexposed inner tank interior surface.

The outer dimensions of the tank may vary depending on how much volume or space is desired between the tank and the inner wall of the vault to contain possible leakage in the event of an accidental rupture of the inner tank.

Figure 8:
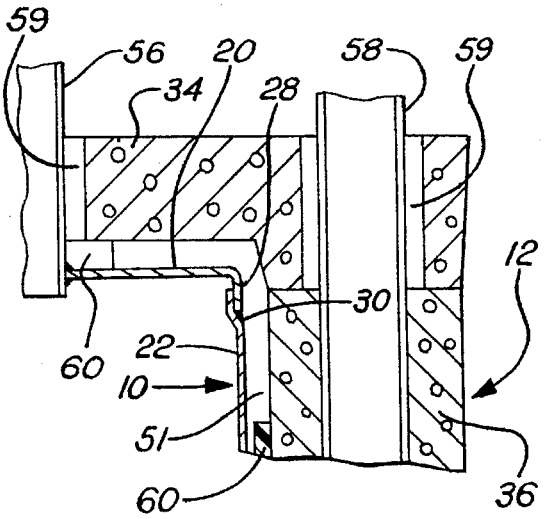
FIG. 8 is a fragmentary sectional view taken on the line 8—8 in FIG. 1.

Various connections may be made through the cap 34 and side wall 36 of the vault. As shown in FIGS. 1 & 8, a pipe 56 is welded to the top wall 20 of tank 10 and communicates with the interior of the tank. Pipe 56 is connected by conduit 57 to a pipe 58 in the side wall 36 of the vault 12 and in cap 34. Grouting 59 and spacers 60 are also shown. The pipes 56 and 58 and conduit 57 may serve any desired purpose. It may serve as a fill line, although a separate fill pipe 74, described more fully hereinafter, is the primary means of filling the tank. Another similar line 59 is also shown. A vent 61 is provided in the cap 34 to vent the space between the tank and vault. A manhole port 68 in cap 34 is provided, closed by a removable cover 70. An electrical conduit 72 connects an electronic high level alarm sensor and an interstitial leak detection sensor 73 to a suitable connection box in the vault wall by the way of suitable passages in the cap 34 and side wall 36.

Figure 5:
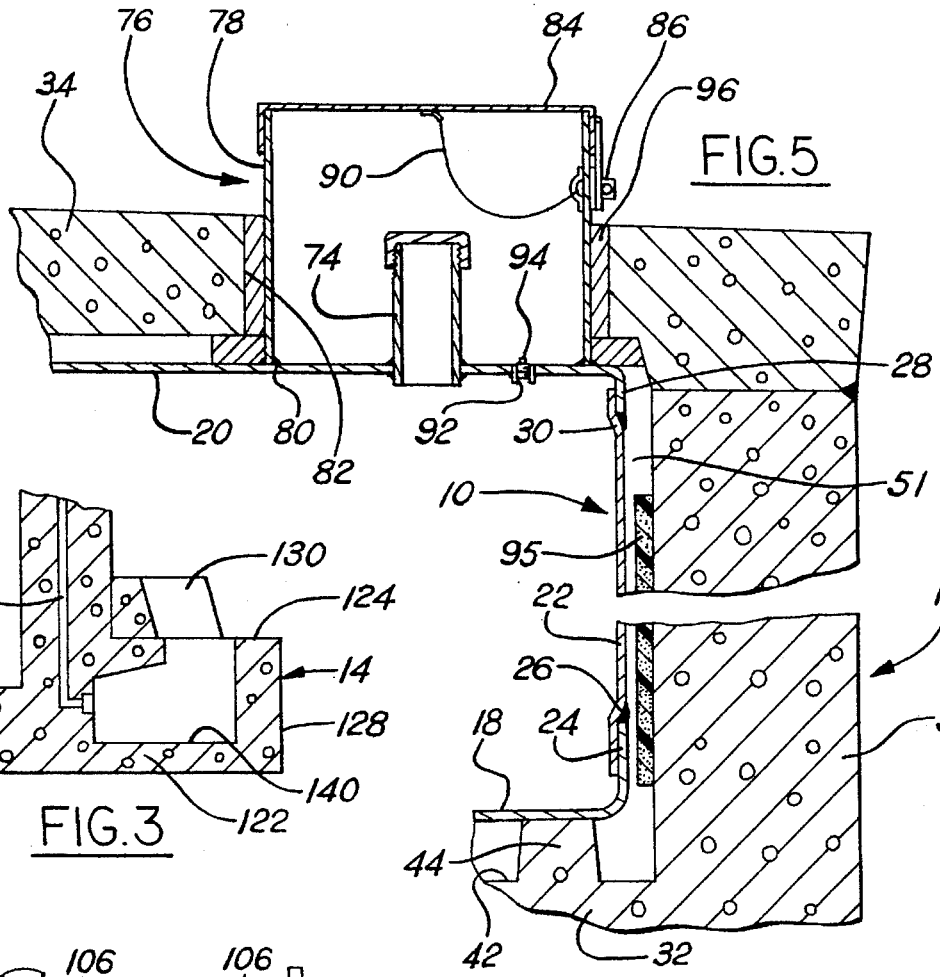
FIG. 5 is a fragmentary sectional view taken on the lie 5—5 in FIG. 1.
Figure 3:
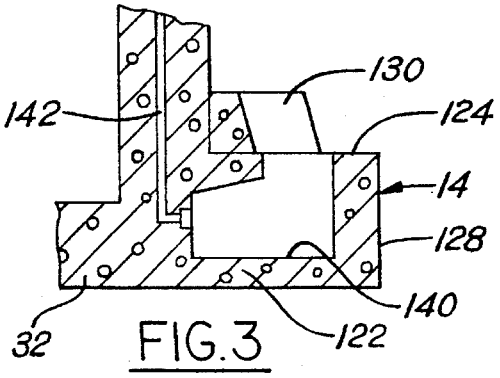
FIG. 3 is a fragmentary sectional view of a portion of FIG. 1 taken on the line 3—3 in FIG. 1 and with the liquid-dispensing pump removed.

Referring to FIGS. 1 & 5, a fill pipe 74, having a removable cap 75, is provided in the top wall 20 of the tank 10. A spill trap 76 comprises an annular shell 78 surrounding the fill pipe 74. The shell is cylindrical and extends vertically upwardly from the top wall 20, being secured thereto as by welding 80 to provide a sealed Joint. The cap 34 of the vault has an opening 82 through which the shell 78 extends. A removable cover 84 closes the upper end of the shell. A lockable hasp 86 releasably secures the cover 84 on the shell. A lanyard 90 attached to the shell 78 and to the cover prevents the cover 84 from becoming lost or separated from the shell. A drain hole 92 in the top wall 20 of the tank is spaced from the fill pipe 74 and surrounded by the shell. A removable plug 94 seals the drain hole. Grouting 96 between the shell and cap 34 are also provided.

In order to fill the tank 10 with liquid, the shell cover 84 and cap 75 must be removed. Any liquid spilled during filling will be contained with the shell 78. The spilled liquid may be allowed to drain into the tank through the drain hole 92 by removing plug 94.

Figure 6:
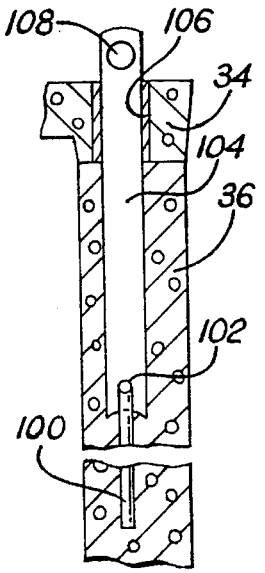
FIG. 6 is a fragmentary sectional view taken on the line 6—6 in FIG. 1.
Figure 7:
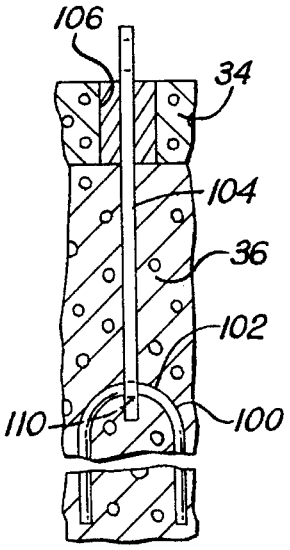
FIG. 7 is a view of the same parts as in FIG. 6 but taken at right angles thereto.

The vault 12, with the tank 10 inside, can be lifted by suitable hoisting equipment. For this purpose, anchors 100 (FIGS. 6, 7) are embedded in the side wall 36 of the vault in circumferentially spaced relation near the upper edge. Each anchor is in the form of a rod of inverted U-shape having a curved byte portion 102 at the top. An elongated, vertical lifting bar 104 is associated with each anchor. Bar 104 is a flat plate partially embedded in the side wall 36 and extending upwardly through an opening 106 in the top wall or cap 34 of the vault with its upper end terminating above the cap. The opening 106 is sealed with grouting around the bar 104 and an aperture 108 in the upper end of the bar 104 can be engaged by the hoisting equipment. The lower end of the lifting bar 104 has an aperture 110 through which the byte portion 102 of the anchor rod extends.

The vault 12 may, if desired, have a concrete peninsula 14 serving as a laterally outward extension of the side wall 36 of the vault. The peninsula is at the bottom of the side wall and may be cast as one piece therewith or may be separately formed and then cemented or bonded to the side wall. The peninsula has a base 122 for supporting the peninsula above ground and a platform surface 124 for supporting a liquid-dispensing pump 16, such as a gasoline pump. The pump 16 is set back from the outer edge 128 of the platform surface 124 to protect the pump from damage resulting from accidental contact with a motor vehicle or other moving object. The peninsula has laterally spaced apart, upraised walls 130 extending upwardly from the platform surface 124 along opposite sides of the pump to further protect the pump. A rear wall 132 of the peninsula spaces the pump away from the side wall 36 of the vault. The base 122 has a sump basin 140 for containing liquid leakage from pump 16. Formed with the vault side wall is a pipe 142 to provide a portion of the liquid passage from the tank 10 to the pump.

I claim:

1. An above ground storage container assembly for volatile liquids comprising:

(a) an inner tank of steel or plastic having a bottom wall, a top wall and side walls providing a substantially closed interior space for containing volatile inflammable liquids;

(b) an outer vault having a bottom wall, a top wall and side walls providing a substantially closed interior space in which said inner tank is disposed; said outer vault, including the bottom, top and side walls thereof, being made of concrete;

(c) the bottom, top and side walls of said outer vault being spaced from the bottom, top and side walls of said inner tank to provide an air envelope around said inner tank;

(d) means for permitting air to flow into and out of said air envelope, (e) and an integral concrete peninsula extending laterally outwardly from said side wall of said outer concrete vault serving as an extension of said outer concrete vault, (f) said concrete peninsula having a base for supporting said peninsula above ground and having a platform surface above said base for supporting a liquid-dispensing pump.

2. An above ground storage container assembly as defined in claim 1, wherein said integral concrete peninsula is formed of one piece with the side wall of said outer concrete vault.

3. An above ground storage container assembly for volatile liquids comprising:

(a) an inner tank of steel or plastic having a bottom wall, a top wall and side walls providing a substantially closed interior space for containing volatile inflammable liquids;

(b) an outer vault having a bottom wall, a top wall and side walls providing a substantially closed interior space in which said inner tank is disposed; said outer vault, including the bottom, top and side walls thereof, being made of concrete;

(c) the bottom, top and side walls of said outer vault being spaced from the bottom, top and side walls of said inner tank to provide an air envelope around said inner tank;

(d) means for permitting air to flow into and out of said air envelope, (e) means for lifting said above ground storage container assembly, said lifting means comprising a plurality of anchors embedded in the side walls of said outer vault in spaced apart relation to one another, and (f) an elongated vertical lifting bar connected to each of said anchors and extending upwardly therefrom through said top wall of said outer vault and having an upper end above said top wall of said outer vault to be engaged by suitable power lifting equipment.

4. An above ground storage container assembly as defined in claim 3, wherein each of said anchors is in the form of a rod of inverted U-shape, and said bar has an apertured lower end through which the rod extends.

5. An above ground storage container assembly for volatile liquids comprising:

(a) an inner tank of steel or plastic having a bottom wall, a top wall and side walls providing a substantially closed interior space for containing volatile inflammable liquids;

(b) an outer vault having a bottom wall, a top wall and side walls providing a substantially closed interior space in which said inner tank is disposed; said outer vault, including the bottom, top and side walls thereof, being made of concrete;

(c) the bottom, top and side walls of said outer vault being spaced from the bottom, top and side walls of said inner tank to provide an air envelope around said inner tank;

(d) means for permitting air to flow into and out of said air envelope, (e) a fill opening in the top wall of said inner tank, (f) a spill trap comprising an annular shell surrounding said fill opening, (g) said shell being secured to said top wall of said inner tank and extending upwardly above said fill opening, (h) a clearance opening in the top wall of said outer vault through which said shell extends, and (i) a removable cap covering said shell.

6. An above ground storage container assembly as defined in claim 5, and further including a fill pipe secured to the top wall of said inner tank in registry with said fill opening and extending upwardly therefrom.

7. An above ground storage container as defined in claim 6, and further including a drain hole in the top wall of said inner tank spaced from said fill pipe and surrounded by said shell, and a removable plug sealing said drain hole.

* * * * *